United States Patent [19]

Stark et al.

[11] 4,250,814

[45] Feb. 17, 1981

[54] DUAL HOPPER CAR DOORS

[75] Inventors: Marvin Stark, Houston, Tex.; Steve L. Suvada, Canfield; Herman A. Aquino, Diamond, both of Ohio

[73] Assignee: Pullman Incorporated, Chicago, Ill.

[21] Appl. No.: 957,255

[22] Filed: Nov. 2, 1978

[51] Int. Cl.[3] ..... B61D 7/04; B61D 7/18; B61D 7/28

[52] U.S. Cl. ..... 105/251; 105/240; 105/280; 105/290

[58] Field of Search ..... 105/240, 241 R, 241 C, 105/244, 250, 251, 252, 280, 415, 290

[56] References Cited

U.S. PATENT DOCUMENTS

| | | | |
|---|---|---|---|
| 1,092,659 | 4/1914 | Mettler | 105/251 |
| 1,436,310 | 11/1922 | Gilpin | 105/280 |
| 1,449,434 | 3/1923 | Murphy | 105/244 |
| 1,706,353 | 3/1929 | Dorey | 105/251 |
| 1,848,901 | 3/1932 | Neikirk | 105/251 |
| 1,869,029 | 7/1932 | Spiller et al. | 105/280 |
| 1,981,714 | 11/1934 | Yost | 105/244 |
| 2,001,155 | 8/1935 | Neikirk | 105/415 |
| 3,447,485 | 6/1969 | Dorey | 105/251 |
| 3,455,253 | 7/1969 | Floehr | 105/251 |
| 3,633,515 | 6/1973 | Shaver et al. | 105/240 |
| 3,805,708 | 4/1974 | Schuller et al. | 105/240 X |
| 3,949,681 | 4/1976 | Miller | 105/250 X |

*Primary Examiner*—Howard Beltran

*Attorney, Agent, or Firm*—Richard J. Myers; Stephen D. Geimer

[57] ABSTRACT

A rapid dump hopper car includes a pair of relatively lightweight doors which are opened and closed sequentially from an overlapping position by means of a longitudinally extending actuating mechanism movably supported on the underframe of the car. The doors include longitudinally spaced and transversely extending hinge bracket structures which are connected to the center sill and side sill of the car for relative hinging movements. The bracket structures also include overlapping portions and interengageable bars securely supporting the adjacent edges of the door in interlocking relation. Each hinged bracket structure also includes a ball and socket connection with actuating links which are connected to the longitudinal operating mechanism.

14 Claims, 8 Drawing Figures

DUAL HOPPER CAR DOORS

BACKGROUND OF THE INVENTION

1. Field of the Invention

The present invention generally relates to hopper cars of a type having bottom dump opening doors such as may be used for discharging coal and the like. More specifically, the invention relates to a hopper car bottom dump door arrangement wherein overlapping lightweight doors include a novel interlocking mechanism and hinge bracket arrangement.

2. Description of the Prior Art

The prior art is typified by U.S. Pat. No. 3,633,515, Shaver, which illustrates a hopper door opening and closing mechanism for an interconnected pair of sequentially opening and closing bottom hopper doors. The present invention improves upon the prior art by providing a hopper car door operating mechanism which includes pivoted hopper doors of a relatively lightweight and simplified construction.

SUMMARY OF THE INVENTION

A railway hopper car of the bottom dump type includes bottom discharge doors which are actuated by means of a door operating mechanism similar to that which is disclosed in the aforementioned patent, U.S. Pat. No. 3,633,515. The discharge doors of the present invention comprise a relatively lightweight construction consisting of upper plate members having channel-shaped downwardly extending flanges extending throughout the lengths of the doors and laterally extending stiffener members. The doors are of the overlapping type which in the closed position provides for one edge of one door being supported by the adjacent edge of the other door and being securely locked in this particular position. The operating mechanism for actuating the doors to the open position is shown particularly in the aforementioned patent, U.S. Pat. No. 3,633,515. In the present disclosure the doors are locked in the closed position by means of bars projecting outwardly from one of the doors and engaging the bars of another door to securely lock the same against opening movement when the operating linkage for both said doors is in the closed position. The doors of the present arrangement are of a desired lightweight construction by virtue of the particularly shaped configuration including the laterally spaced stiffeners, the downwardly projecting flanges, and the longitudinally spaced and laterally extending plate members which at one side of the door form hinges and which at the other side of the door form the interengaging locking means which during the overlapping position of the doors securely locks the same in the closed position.

DESCRIPTION OF THE PREFERRED EMBODIMENT

Figure 1:
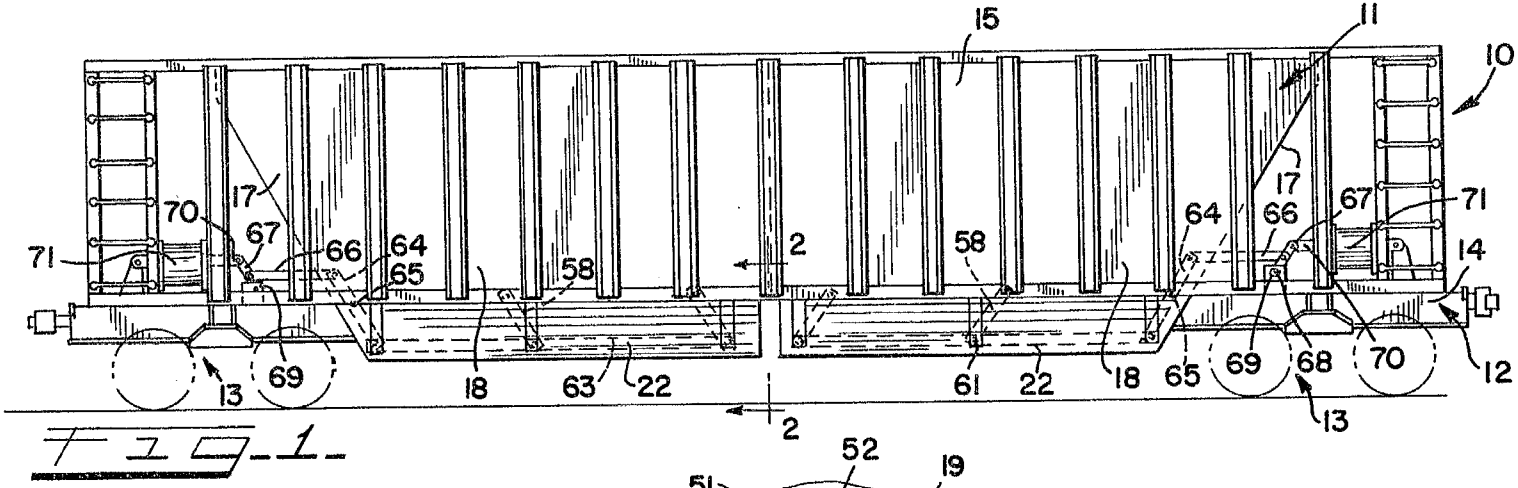
FIG. 1 is a side elevational view of a railway hopper car embodying the present invention.
Figure 2:
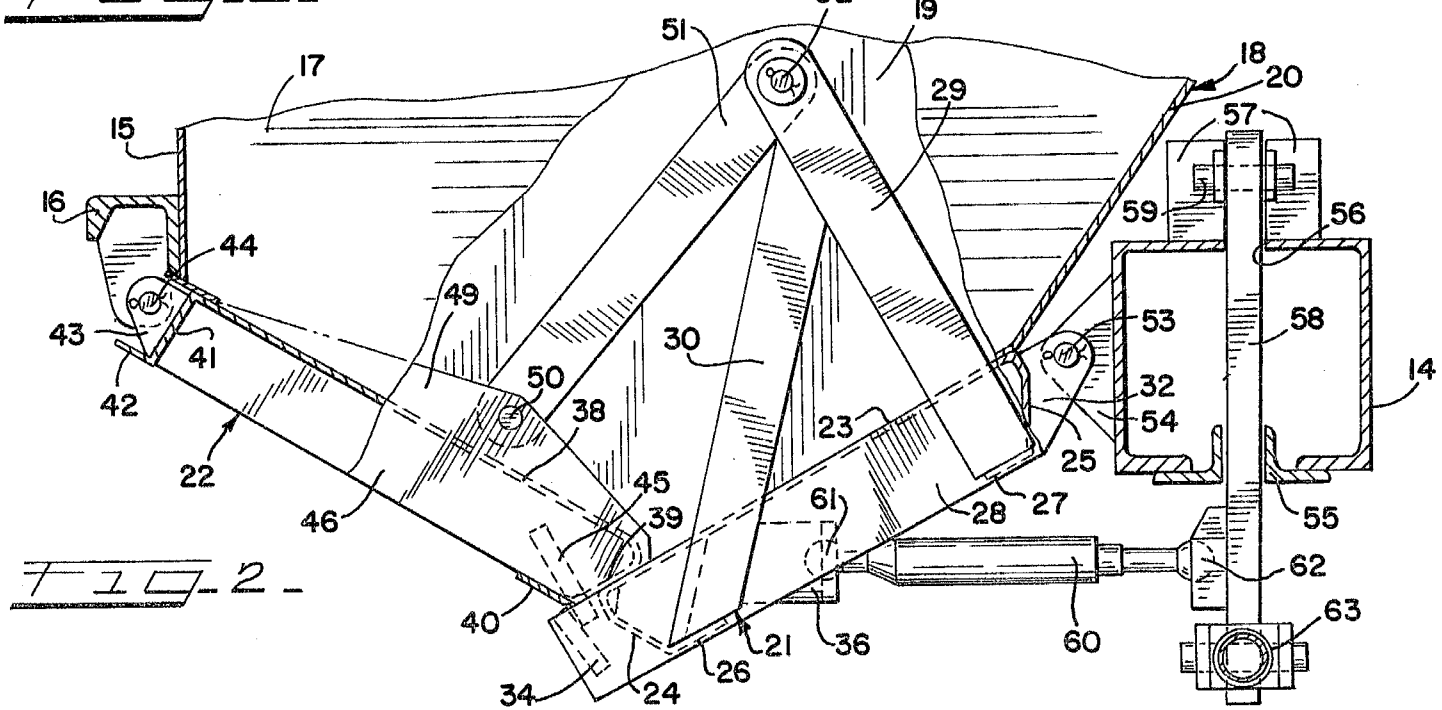
FIG. 2 is a cross-sectional view taken substantially along the lines 2—2 of FIG. 1.
Figure 5:
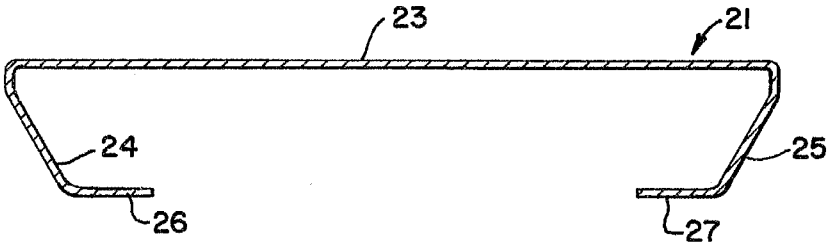
FIG. 5 is a cross-sectional view taken along the lines 5—5 disclosing generally the shape of the door.
Figure 6:
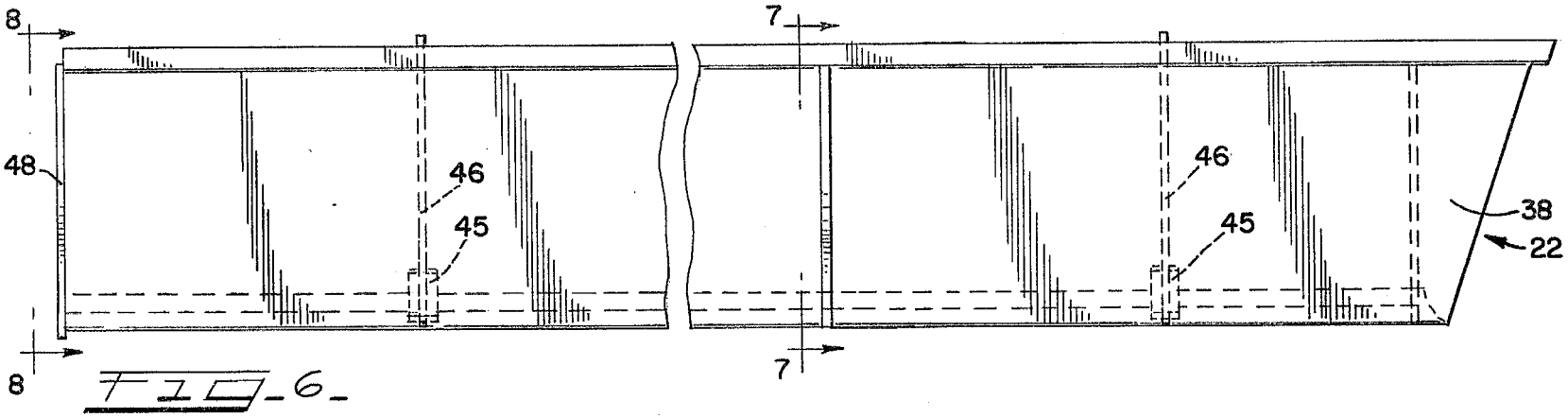
FIG. 6 is a plan view similar to FIG. 3 showing a portion of the other door of the present invention.

A railway hopper car 10, as shown in FIG. 1, includes a car body 11 having an underframe structure 12 supported on conventional car trucks 18. The car 10 comprises a center sill 14 supported on the car trucks 13. The car body 11 includes side walls 15 projecting upwardly and connected to conventional side sills 16. The car 10 includes at opposite ends thereof, sloping end walls 17 providing hopper structures 18. The hopper structures 18 include at the central portion of the car, adjacent end walls 19 which are suitably connected to inner sloping walls 20 as best shown in FIG. 2. The present railway car discloses a total of four hoppers, longitudinally spaced pairs being disposed on opposite sides of the center sill 14 of the car. Each of the hoppers 18 comprises a pair of doors including an inner door 21 and an outer door 22. The doors as best shown in FIGS. 5 and 7 are of a relatively channel-shaped construction.

Figure 4:
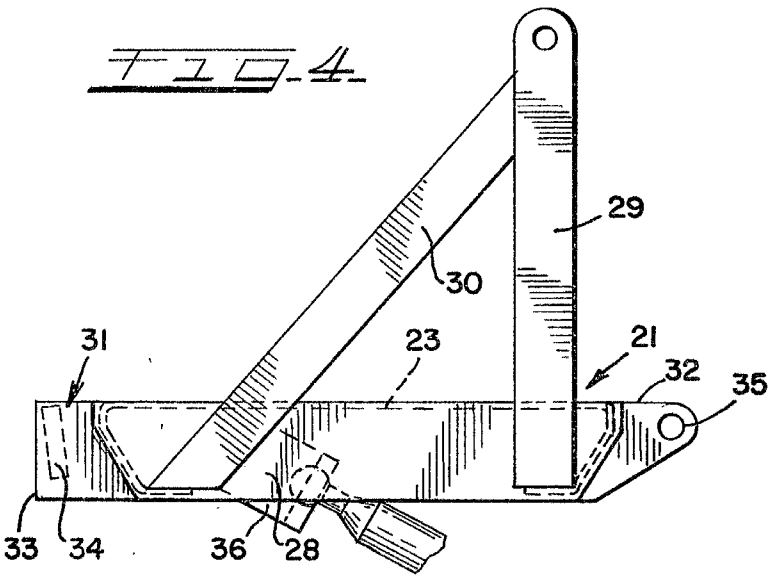
FIG. 4 is an end elevational view taken substantially along the line 4—4 of FIG. 3.

The inner doors 21 each include a longitudinal plate 23 having vertical flanges 24 and 25 projecting downwardly and being integral with the longitudinal plate 23. As best shown in FIG. 2 the downwardly extending flange 24 of the inner door 23 is provided with an inwardly extending horizontal flange 26 parallel to the longitudinal plate 23. Similarly, and as best shown in FIG. 5, the downwardly extending flange 25 is integral with a flange 27 extending toward the flange 26 and being substantially parallel to the longitudinal plate 23. As best shown in FIG. 4, the inner door 21 is provided at opposite ends thereof with end plates 28 suitably secured to the inner door by welding or other fastening means. The plates 28 have connected thereto at opposite ends of the door vertically extending pivot arms 29 and being reinforced by means of diagonally extending braces 30.

Figure 3:
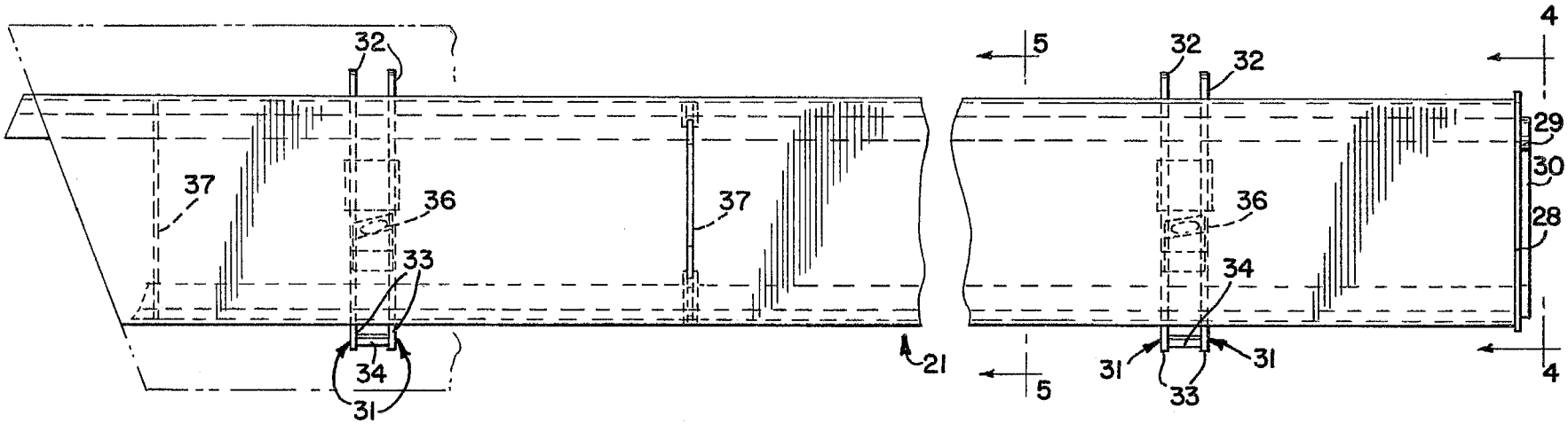
FIG. 3 is a plan view showing partially the door panel of the present invention.

As best shown in FIGS. 2 and 3, the inner doors 21 each include two pairs of transversely extending and longitudinally spaced vertical plates 31 which at one end form hinged bracket portions 32 and at the other end lock projecting portions 33. The lock projecting portions 33 have connected thereto lock bars 34 substantially parallel to the longitudinal center line of the inner door 21. The spaced plates 31 also include the aforementioned hinged bracket portions 32 having hinge openings 35 for hingedly connecting the doors 31 to the center sill of the car. The spaced plates 31 also support push pull brackets 36. The transversely spaced plates 31, and the shape of the doors 21 in combination with stiffeners 37 which are suitably connected by welding to said doors, at longitudinally spaced intervals, provide for a light but relatively strong construction with the use of a minimum number of parts. The parts are effectively positioned to provide for maximum strength and lightness of the assembly as desired.

Figure 7:
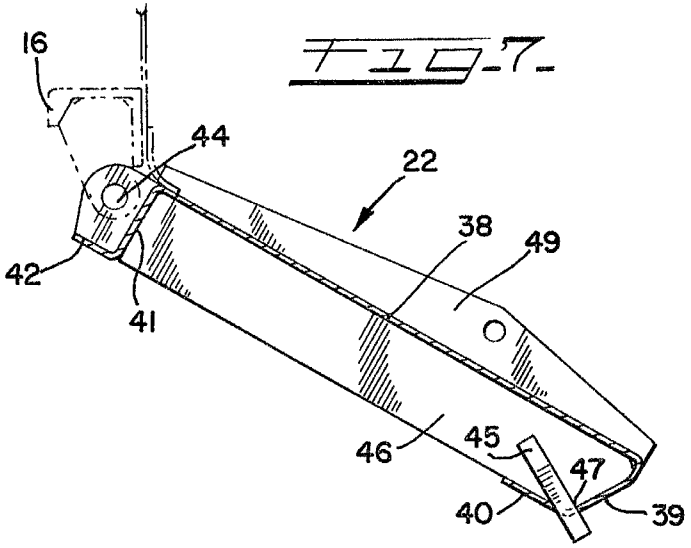
FIG. 7 is a cross-sectional view taken substantially along the line 7—7 of FIG. 6
Figure 8:
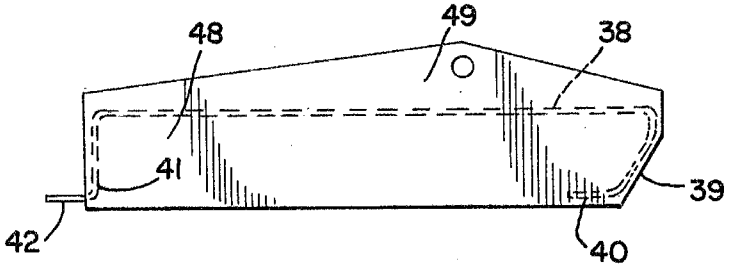
FIG. 8 is an end elevational view taken substantially along the line 8—8 of FIG. 6.

The outer door 22 as best shown in FIGS. 2, 6, 7 and 8 includes a longitudinal plate 38 having downwardly projecting flanges 39 integral with and connected to a flange 40 parallel to the plate 38. The plate 38 also includes a downwardly extending flange 41 and an outwardly extending flange 42 projecting outwardly laterally with respect to the door 22. As best shown in FIG. 7 hinge brackets 43 are securely connected to the flanges 42 and 41 and to the side sills 16 by means of hinge pins 44. The flanges 39 and 40 of the door 22 are provided with a slot 47 through which a bar or tab 45 projects the said bar 45 being securely welded to the transverse plate 46. As best shown in FIG. 8 the outer door 22 also includes end plates 48 welded thereto and having upper projecting plate portions 49. As best shown in FIG. 2 the upper plate portions 49 include a pivot 50 hingedly supporting links 51, provided at opposite ends of the doors 21 and 22, and being hingedly connected to the pivot arms 29 by means of pivots 52. The hinge bracket portions 32 of the doors 23 are hingedly connected by means of hinge pins 53 to hinge ears 54 suitably supported on the center sill 14. As best shown in FIG. 2 the center sill 14 is apertured at its lower end and includes lever guide portions 55 which are in registry with upper recesses 56 in the center sill 14. Brackets 57 supported on top of the center sill 14, on opposite sides of the recess 56, pivotally support actuating arms 58 by means of pivot pins 59. Thus the actuating arms 58 are adapted to pivot within the recesses 56 and lower guides 55 in a swinging longitudinal direction. A plurality of links 60 are connected to the push pull brackets 36 by means of ball and socket connections 61. Similarly, the links 60 are connected to the actuating arms 58 by means of ball and socket connections 62.

As best shown in FIGS. 1 and 2 the lower ends of the actuating arms 58 are suitably connected for pivotal movement to a longitudinal actuating bar and mechanism designated at 63. The arrangement shown in FIG. 2 is duplicated on the opposite sides of the center line of said car and thus each actuating bar 63 functions to open and close pairs of oppositely disposed door arrangements. The bars 63 are suitably connected to end levers 64 which are pivotally supported on the hopper structure as indicated generally at 65. The longitudinally extending link 66 is pivotally connected to each of the end levers 64 and pivotally connected to the pivot link 67 pivotally supported by means of a pivot 68 to a bracket 69 suitably carried by the structure of the hopper car. Each pivot link 67 is connected to a piston rod 70 in turn reciprocating within an air cylinder 71 which is actuated to open and close the doors in a manner similar to the aforementioned prior art patent U.S. Pat. No. 3,633,515.

OPERATION

The operation of the air cylinder 71 and associated linkage arrangement is similar to that shown in the aforementioned U.S. Pat. No. 3,633,515. Actuation of the piston rod 70 provides for pivoting movement of the link 67 and longitudinal adjustment of the link 66 thereby pivoting the end lever 64 about the pivot 65. As the end lever 64 pivots the longitudinal acting bar of each of the door mechanisms 63 is moved longitudinally causing hinged movement of the actuating arms 58 about the pivot connections 59. Movement in one direction of the bar 58 provides for rotation of the links 66 in a horizontal plane to provide for hinging movement of the inner doors 21 about the pivots 53 downwardly to swing the doors 21 and 22 to the open position. As best shown in FIG. 2 the adjacent ends of the doors 21 and 22 are in overlapping relation with the bars 45 in locked engagement with the bars 34. The swinging movement downwardly of the door 21 disengages the locking relation of the bars 34 and 45 whereupon the door 46 in response to the rotation of the link 51 moves the doors 22 to the open position. The movement of the doors in response to actuation of the actuating arms 58 also is assisted by the force of gravity of the material contained within the hopper car which bears upon and is supported by the longitudinal plates 23 and 38.

The present door arrangement provides a light and functional construction of relatively few parts wherein the shape of the element is particularly important in providing maximum strength and rigidity. This is achieved by the particular channel-shaped construction of the doors. Further the stiffeners which are longitudinally spaced and transversely connected to the doors provide for rigidity with the door hinge and interlocking bracket constructions contributing not only functionally in the closure and effective locking of the doors but also in the strength and reinforcement of the same. The interlocking bar constructions provide for the effective closure and locking of the doors. The spaced plates 31 also provide for the hinging action, and further provide connecting means for the links 60 which are effective to open and close the doors.

What is claimed is:

1. A railroad hopper car comprising a longitudinally extending hopper structure having a downwardly facing discharge opening, first and second doors hingedly connected to said hopper for downward and outward swinging movement to an open position;

linkage means interconnecting said doors for conjoint movement; and said first door comprising a channel shaped member including a first longitudinal plate portion and a first hopper adjacent flange extending from one end of the longitudinal portion and a first free end flange extending from the other end of the longitudinal portion, each flange having an inwardly extending first free end portion directed toward the other free end portion, and said second door comprising a channel shaped member including a second longitudinal plate portion and a second hopper adjacent flange extending from one end of the second longitudinal portion and a second free end flange extending from the other end of the second horizontal portion, the second hopper adjacent end flange having an outwardly extending second free end portion and said second free end flange having an inwardly directed second free end portion, whereby the inwardly directed end portions of each door at the distal end are adjacent when the doors are closed.

2. The invention in accordance with claim 1, said first and second doors including a plurality of stiffeners longitudinally spaced of the door and connected to the underneath surface of said plate portions and to said flanges.

3. The invention in accordance with claim 1, each of said flange end portions being extended parallel to said first and second door plate portions.

4. The invention in accordance with claim 1, and hinge means supported on each of said hopper adjacent flanges.

5. The invention in accordance with claim 1, actuating means supported on said hopper structure and connected to said first door for actuating said swinging movement.

6. The invention in accordance with claim 5, said linkage means comprising, a first link rigidly connected to said first door and extending upwardly with respect thereto, and a second slave link pivotally connected to said second door and pivotally connected to said first link.

7. The invention in accordance with claim 1, interlocking means interengageable in the closed position of said doors comprising, first projecting means on said first door extending outwardly with respect to one edge portion of said first door, a second projecting means on said second door extending outwardly from another one edge portion of said second door and into overlapping engagement with said first projecting means.

8. The invention in accordance with claim 7, said first projecting means including a pair of laterally spaced vertical plate members extending transversely with respect to said first door and projecting outwardly with respect to an inner edge portion of said first door thereby providing hinge means for connecting said first doors to said hopper structure.

9. The invention in accordance with claim 8, said second projecting means exerting an outward and downward tension force on said first door.

10. The invention in accordance with claim 8, said first projecting means comprising a pair of laterally spaced ears, a first bar extending transversely of and connected to said ears in laterally outwardly spaced relation with respect to the outer edge of said first door, and said second projecting means comprising a second bar in the closed position overlapping said first bar.

11. The invention in accordance with claim 8, said actuating means including a longitudinally extending horizontal member movably supported on said car adjacent to said hopper structure, an actuating arm pivotally connected with said horizontal member and pivotally connected to said vertical plate members whereupon reciprocation of said horizontal member said doors are moved between open and closed positions.

12. The invention in accordance with claim 7, each of said projecting means comprising at least a pair of longitudinally spaced transversely extending vertical plate means connected to each of said doors to reinforce the same.

13. The invention in accordance with claim 12, said plate means each including a hinge portion projecting outwardly from said hopper adjacent flange of each of said doors and being hingedly connected to said hopper car.

14. The invention in accordance with claim 13, each of said plate means of said first projecting means comprising a pair of longitudinally spaced plate members, a first bar connected with said plate members, said second projecting means comprising a second bar in the locked position of said doors engaging said first bar in interlocking relation.

* * * * *